US011261867B2

(12) United States Patent
Tatsuwaki et al.

(10) Patent No.: US 11,261,867 B2
(45) Date of Patent: Mar. 1, 2022

(54) COMPRESSOR COMPRISING A COMPRESSION MECHANISM DRIVEN BY A MAIN SHAFT HAVING A BALANCE WEIGHT COMPRISING AN ANNULAR OIL-RECEIVING RECESSED PORTION COMMUNICATING WITH A PART OF A HOLLOW PORTION OF THE BALANCE WEIGHT

(71) Applicant: Mitsubishi Electric Corporation, Tokyo (JP)

(72) Inventors: Kohei Tatsuwaki, Tokyo (JP); Fumihiko Ishizono, Tokyo (JP); Tomokazu Matsui, Tokyo (JP); Shuhei Koyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 256 days.

(21) Appl. No.: 16/348,887

(22) PCT Filed: Jan. 11, 2017

(86) PCT No.: PCT/JP2017/000607
§ 371 (c)(1),
(2) Date: May 10, 2019

(87) PCT Pub. No.: WO2018/131088
PCT Pub. Date: Jul. 19, 2018

(65) Prior Publication Data
US 2019/0323505 A1 Oct. 24, 2019

(51) Int. Cl.
*F04C 29/02* (2006.01)
*F04C 18/02* (2006.01)
*F04B 39/02* (2006.01)

(52) U.S. Cl.
CPC ..... *F04C 29/025* (2013.01); *F04C 18/0215* (2013.01); *F04B 39/0246* (2013.01); *F04B 39/0261* (2013.01); *F04C 2240/807* (2013.01)

(58) Field of Classification Search
CPC ..... F04C 29/025; F04C 18/0215; F04C 2240/807; F04C 23/008; F04C 29/028; F04B 39/0246; F04B 39/0261
(Continued)

(56) References Cited

U.S. PATENT DOCUMENTS

RE34,297 E * 6/1993 Elson ..... F04C 29/028 310/88
5,439,361 A * 8/1995 Reynolds ..... F04C 29/028 418/55.6

(Continued)

FOREIGN PATENT DOCUMENTS

JP 2014-109223 A 6/2014

*Primary Examiner* — Kenneth J Hansen
*Assistant Examiner* — Benjamin Doyle
(74) *Attorney, Agent, or Firm* — Posz Law Group, PLC

(57) ABSTRACT

A compressor includes a compression mechanism that compresses refrigerant; a main shaft that transmits a rotational driving force to the compression mechanism; a balance weight provided below the compression mechanism and integrated with the main shaft, the balance weight having a cylindrical outer peripheral surface centered at the main shaft; and an oil sump portion provided below the balance weight and stores lubricating oil to be supplied to the compression mechanism. The balance weight has an annular oil-receiving recessed portion in an upper surface, the oil-receiving recessed portion being centered at the main shaft and integrated with the balance weight. The balance weight has a hollow portion in a lower surface, the hollow portion extending in part of the lower surface in a peripheral direction around the main shaft and being integrated with the (Continued)

balance weight. The oil-receiving recessed portion communicates with at least part of the hollow portion.

10 Claims, 4 Drawing Sheets

(58) Field of Classification Search
USPC ..... 417/410.3; 418/88, 94, 55.6
See application file for complete search history.

(56) References Cited

U.S. PATENT DOCUMENTS 5,772,416 A * 6/1998 Caillat ..... F01C 1/0215 418/55.6
6,247,907 B1 * 6/2001 Williams ..... F04C 23/008 417/368
6,305,914 B1 * 10/2001 Lifson ..... F04C 29/0021 417/410.5
7,766,632 B2 * 8/2010 Suh ..... F04C 29/0085 418/55.6
7,942,656 B2 * 5/2011 Suh ..... F04C 18/0215 418/151
10,859,083 B2 * 12/2020 Takamura ..... F04C 18/0215
2004/0179967 A1 * 9/2004 Morozumi ..... F04C 23/008 418/55.1
2006/0127262 A1 * 6/2006 Shin ..... F04C 23/008 418/55.6
2007/0217936 A1 * 9/2007 Oh ..... F04C 29/026 418/55.6
2010/0150752 A1 * 6/2010 Nakamura ..... F04C 29/028 417/410.5
2014/0205484 A1 * 7/2014 Ignatiev ..... F01C 1/0215 418/55.3
2015/0078945 A1 * 3/2015 Su ..... F04C 18/0215 418/55.1
2017/0089341 A1 * 3/2017 Takamura ..... F04C 23/008
2017/0254331 A1 * 9/2017 Noro ..... F04C 29/02
2017/0314557 A1 * 11/2017 Matsui ..... F04C 18/0215

* cited by examiner

COMPRESSOR COMPRISING A COMPRESSION MECHANISM DRIVEN BY A MAIN SHAFT HAVING A BALANCE WEIGHT COMPRISING AN ANNULAR OIL-RECEIVING RECESSED PORTION COMMUNICATING WITH A PART OF A HOLLOW PORTION OF THE BALANCE WEIGHT

CROSS REFERENCE TO RELATED APPLICATION

This application is a U.S. national stage application of PCT/JP2017/000607 filed on Jan. 11, 2017, the contents of which are incorporated herein by reference.

TECHNICAL FIELD

The present invention relates to a compressor including a balance weight.

BACKGROUND ART

A scroll fluid machine is disclosed in Patent Literature 1. This scroll fluid machine includes a balancer provided between a frame and an electric motor mechanism and that rotates together with a main shaft; a balancer cover including a hollow portion enclosing the outer periphery of the balancer and an oil-receiving portion that receives lubricating oil provided for lubrication, and an oil-discharge pipe through which the lubricating oil received by the oil-receiving portion is returned to an oil sump. In the scroll fluid machine disclosed in Patent Literature 1, the lubricating oil leaked from the main bearing can be prevented from touching the balancer. Consequently, the oil can be prevented from oil loss.

CITATION LIST

Patent Literature

Patent Literature 1: Japanese Unexamined Patent Application Publication No. 2014-109223

SUMMARY OF INVENTION

Technical Problem

The scroll fluid machine disclosed by Patent Literature 1, however, requires an increased number of components, leading to a problem of an increase in the manufacturing cost.

The present invention is to solve the above problem and provides a compressor in which stirring of lubricating oil is prevented while the increase in the number of components is suppressed.

Solution to Problem

A compressor according to an embodiment of the present invention includes a compression mechanism that compresses refrigerant; a main shaft that transmits a rotational driving force to the compression mechanism; a balance weight provided below the compression mechanism and integrated with the main shaft, the balance weight having a cylindrical outer peripheral surface centered at the main shaft; and an oil sump portion provided below the balance weight and stores lubricating oil to be supplied to the compression mechanism. The balance weight has an annular oil-receiving recessed portion in an upper surface, the oil-receiving recessed portion being centered at the main shaft and integrated with the balance weight. The balance weight has a hollow portion in a lower surface, the hollow portion extending in part of the lower surface in a peripheral direction around the main shaft and being integrated with the balance weight. The oil-receiving recessed portion communicates with at least part of the hollow portion.

Advantageous Effects of Invention

According to the embodiment of the present invention, the lubricating oil supplied to the compression mechanism and running down the main shaft flows into the oil-receiving recessed portion, and is discharged to the oil sump portion through the hollow portion. Hence, the contact between the lubricating oil and the refrigerant can be suppressed. Consequently, the stirring of the lubricating oil by the refrigerant can be prevented. Furthermore, the oil-receiving recessed portion and the hollow portion are both integrated with the balance weight, and the balance weight is integrated with the main shaft. Accordingly, the increase in the number of components forming the compressor can be suppressed.

DESCRIPTION OF EMBODIMENTS

Embodiment 1

Figure 1:
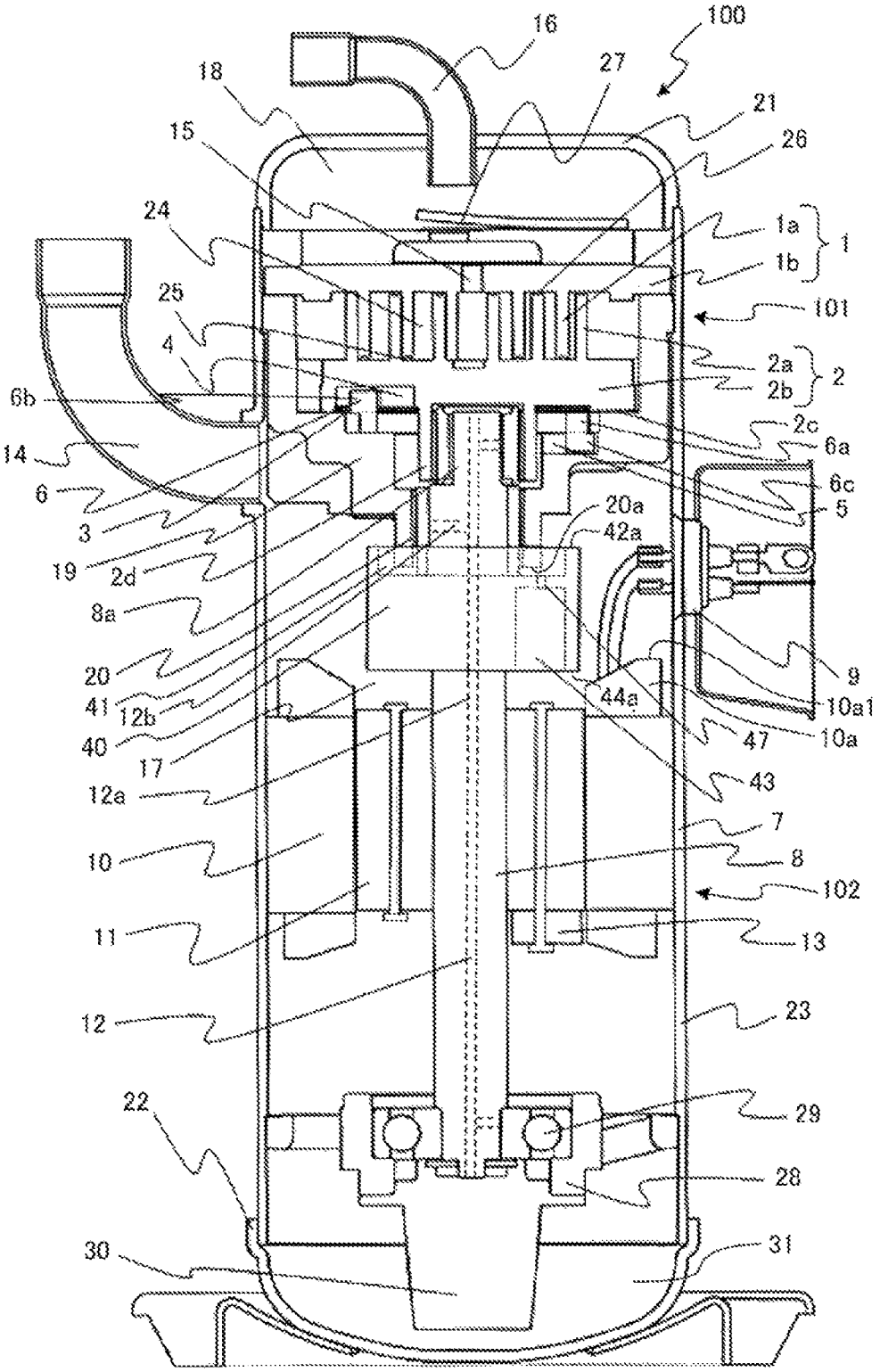
FIG. 1 is a sectional view illustrating an outline configuration of a compressor 100 according to Embodiment 1 of the present invention.

A compressor according to Embodiment 1 of the present invention will now be described. FIG. 1 is a sectional view illustrating an outline configuration of a compressor 100 according to Embodiment 1 of the present invention. The compressor 100 is a fluid machine that sucks refrigerant circulating through a refrigeration cycle and compresses the refrigerant into a high-temperature, high-pressure state before discharging the refrigerant. The compressor 100 is one of constitutional elements of a refrigeration cycle apparatus intended for any of various industrial machines such as a refrigerator, a freezer, a vending machine, an air-conditioning apparatus, a refrigeration apparatus, and a water heater. The compressor 100 according to Embodiment 1 is a scroll compressor, for example. Relative positions (such as the vertical positional relationship or any other similar relationships) of elements described herein are based on a state where the compressor 100 is installed for use, in principle.

As illustrated in FIG. 1, the compressor 100 includes a compression mechanism 101 that compresses refrigerant, an electric motor 102 that drives the compression mechanism 101, and a casing 7 (for example, an airtight container) that houses the compression mechanism 101 and the electric motor 102. In the casing 7, the compression mechanism 101 is positioned in an upper part, and the electric motor 102 is positioned below the compression mechanism 101.

The casing 7 includes a center shell 23, an upper shell 21 provided at the top of the center shell 23, and a lower shell 22 provided at the bottom of the center shell 23. The lower shell 22 forming the bottom of the casing 7 includes an oil sump portion 31 in which lubricating oil is stored. The center shell 23 is provided with a suction pipe 14 forming an intake for sucking refrigerant gas. The upper shell 21 is provided with a discharge pipe 16 forming an outlet for discharging the refrigerant gas. The inside of the center shell 23 serves as a low-pressure chamber 17. The inside of the upper shell 21 serves as a high-pressure chamber 18.

The compression mechanism 101 is a combination of a fixed scroll 1 fixed to the casing 7, and an orbiting scroll 2 that orbits around the fixed scroll 1. The fixed scroll 1 includes a fixed-scroll base plate 1*b*, and a fixed-scroll lap 1*a* forming a scroll projection standing on one side of the fixed-scroll base plate 1*b*. The orbiting scroll 2 includes an orbiting-scroll base plate 2*b*, and an orbiting-scroll lap 2*a* forming a scroll projection standing on one side of the orbiting-scroll base plate 2*b*. The orbiting-scroll lap 2*a* has substantially the same shape as that of the fixed-scroll lap 1*a*. The other side (i.e., a side opposite to the side having the orbiting-scroll lap 2*a*) of the orbiting-scroll base plate 2*b* serves as a thrust-bearing surface 2*c*. The orbiting scroll 2 and the fixed scroll 1 are supported from the lower side thereof by a frame 19 having a suction port (not illustrated) from which the refrigerant gas is sucked.

A thrust-bearing load occurring on the orbiting scroll 2 while the compressor is in operation is borne by the frame 19 at the thrust-bearing surface 2*c*. A thrust plate 3 for increasing slidability is provided between the frame 19 and the thrust-bearing surface 2*c*.

The orbiting scroll 2 and the fixed scroll 1 are provided in the casing 7, with the orbiting-scroll lap 2*a* and the fixed-scroll lap 1*a* being in mesh with each other. The orbiting scroll 2 and the fixed scroll 1 are in mesh with each other with a phase difference of 180 degrees between the fixed-scroll lap 1*a* and the orbiting-scroll lap 2*a*. A compression chamber 24 is provided between the orbiting-scroll lap 2*a* and the fixed-scroll lap 1*a*. The capacity of the compression chamber 24 is variable. To suppress the leakage of refrigerant at the end faces of the fixed-scroll lap 1*a* and the orbiting-scroll lap 2*a*, a seal 25 and a seal 26 are provided at the end face of the fixed-scroll lap 1*a* and the tip of the orbiting-scroll lap 2*a*, respectively.

The fixed scroll 1 is fixed to the frame 19 with members such as bolts. The fixed-scroll base plate 1*b* of the fixed scroll 1 has in a central part thereof a discharge port 15 from which the refrigerant gas compressed in the compression chamber 24 and having a high pressure is discharged. The refrigerant gas compressed and having a high pressure is discharged from the discharge port 15 into the high-pressure chamber 18 provided above the fixed scroll 1. The discharge port 15 is provided at the outlet thereof with a discharge valve 27 that prevents the backflow of the refrigerant from the high-pressure chamber 18 toward the discharge port 15. The refrigerant gas discharged into the high-pressure chamber 18 flows through the discharge pipe 16 and is discharged into the refrigeration cycle.

The side of the orbiting scroll 2 that is opposite to the side having the orbiting-scroll lap 2*a* has a hollow cylindrical boss portion 2*d* in a substantially central part thereof. An eccentric shaft portion 8*a*, to be described below, is positioned in the boss portion 2*d*.

An Oldham ring 6 is provided between the frame 19 and the orbiting scroll 2. The frame 19 has a pair of Oldham-key grooves 5. The orbiting scroll 2 has a pair of Oldham-key grooves 4. The Oldham ring 6 includes a ring portion 6*a*, a pair of Oldham keys 6*b* provided on an upper surface of the ring portion 6*a*, and a pair of Oldham keys 6*c* provided on a lower surface of the ring portion 6*a*. The Oldham keys 6*b* are fitted in the Oldham-key grooves 4 of the orbiting scroll 2. The Oldham keys 6*c* are fitted in the Oldham-key grooves 5 of the frame 19. The Oldham keys 6*b* and 6*c* move back and forth on sliding surfaces formed in the respective Oldham-key grooves 4 and 5, which are filled with lubricating oil. The Oldham ring 6 prevents the axial rotation of the orbiting scroll 2. Therefore, the orbiting scroll 2 to which a rotational force generated by the electric motor 102 is transmitted undergoes an orbital motion, without undergoing the axial rotation, relative to the fixed scroll 1.

The electric motor 102 includes a rotor 11, a stator 10 positioned on the outer side of the rotor 11, and a main shaft 8 shrink-fitted to the inner periphery of the fixed scroll 1. The stator 10 is shrink-fitted to the inner periphery of the center shell 23. The stator 10 is supplied with electric power through a power-supply terminal 9 provided on the center shell 23. The rotor 11 rotates when the stator 10 is powered on, whereby the main shaft 8 is rotated.

The main shaft 8 rotates with the rotation of the rotor 11 and transmits a rotational driving force generated by the electric motor 102 to the compression mechanism 101. An upper part of the main shaft 8 is supported by a main bearing 20 (an exemplary bearing) provided on the frame 19 such that the upper part of the main shaft 8 can be rotated. The main shaft 8 includes at an upper end thereof the eccentric shaft portion 8*a* that is decentered from a center axis of the main shaft 8. The eccentric shaft portion 8*a* is positioned in the boss portion 2*d* of the orbiting scroll 2. A lower part of the main shaft 8 is supported by a secondary bearing 29 such that the lower part of the main shaft 8 can be rotated. The secondary bearing 29 is press-fitted in a bearing-fitting portion provided in a central part of a subframe 28 positioned in a lower part of the casing 7. The subframe 28 is provided with a displacement-type oil pump 30 that pumps the lubricating oil stored in the oil sump portion 31. The lubricating oil pumped by the oil pump 30 is supplied to sliding parts, such as the compression mechanism 101 and the main bearing 20, through an oil-supply hole 12 provided in the main shaft 8. The oil-supply hole 12 includes an axial-direction hole 12*a* extending through the main shaft 8 in the axial direction, and a plurality of lateral holes (for example, a lateral hole 12*b*) extending in the radial direction of the main shaft 8 from the axial-direction hole 12*a* toward an outer peripheral surface of the main shaft 8. The main bearing 20 is supplied with the lubricating oil in the oil sump portion 31 through the axial-direction hole 12*a* and the lateral hole 12*b*.

A first balance weight 40 (an exemplary balance weight) is provided below the compression mechanism 101, the frame 19, and the main bearing 20 and above the electric motor 102 (for example, the rotor 11). The first balance weight 40 is integrated with the main shaft 8, thereby rotating together with the main shaft 8. The first balance weight 40 is positioned in the low-pressure chamber 17. The configuration of the first balance weight 40 will be described below with reference to FIGS. 2 to 5.

The rotor 11 is provided with a second balance weight 13 at the lower end thereof. The second balance weight 13 is integrally fixed to the rotor 11 with fastening members such as rivets. The first balance weight 40 and the second balance weight 13 are provided to cancel the imbalance occurring by the eccentric orbital motion of the orbiting scroll 2.

An operation of the compressor 100 will now be described.

When the power-supply terminal 9 is powered on, an electric current flows through a coil portion of the stator 10, whereby a magnetic field is generated. The magnetic field causes the rotor 11 to rotate. Specifically, a torque occurs on the stator 10 and the rotor 11, whereby the rotor 11 rotates. When the rotor 11 rotates, the main shaft 8 is rotated. When the main shaft 8 is rotated, the orbiting scroll 2 that is prevented from rotating axially by the Oldham ring 6 undergoes an orbital motion.

While the rotor 11 is rotating, the balance under the eccentric orbital motion of the orbiting scroll 2 is held by the first balance weight 40 provided on the upper part of the main shaft 8 and integrated with the main shaft 8, and by the second balance weight 13 fixed to the bottom of the rotor 11. With the eccentric orbital motion of the orbiting scroll 2, the refrigerant is compressed by a known compression principle.

Some of the low-pressure refrigerant gas having flowed from the suction pipe 14 into the low-pressure chamber 17 is sucked into the compression chamber 24 through the suction port provided in the frame 19 (a suction step). The remaining portion of the low-pressure refrigerant gas having flowed into the low-pressure chamber 17 flows through slots (not illustrated) provided in a steel plate forming the stator 10 and cools the electric motor 102 and the lubricating oil. With the orbital motion of the orbiting scroll 2, the compression chamber 24 gradually moves toward the center of the orbiting scroll 2. With the movement of the compression chamber 24, the capacity of the compression chamber 24 is gradually reduced, whereby the refrigerant gas in the compression chamber 24 is compressed (a compression step). The compressed refrigerant gas flows into the discharge port 15 provided in the fixed scroll 1, push-opens the discharge valve 27, and flows into the high-pressure chamber 18 (a discharge step). The high-pressure refrigerant gas having flowed into the high-pressure chamber 18 is discharged from the casing 7 through the discharge pipe 16. The low-pressure chamber 17 and the high-pressure chamber 18 are airtightly separated from each other by the fixed scroll 1 and the frame 19.

The thrust-bearing load generated by the pressure of the refrigerant gas in the compression chamber 24 is borne by the frame 19 that supports the thrust-bearing surface 2*c*. A centrifugal force and a refrigerant-gas load that are generated with the rotation of the main shaft 8 and act on the first balance weight 40 and the second balance weight 13 are borne by the main bearing 20 and the secondary bearing 29. When the power supplied to the stator 10 is cut, the operation of the compressor 100 stops.

Figure 2:
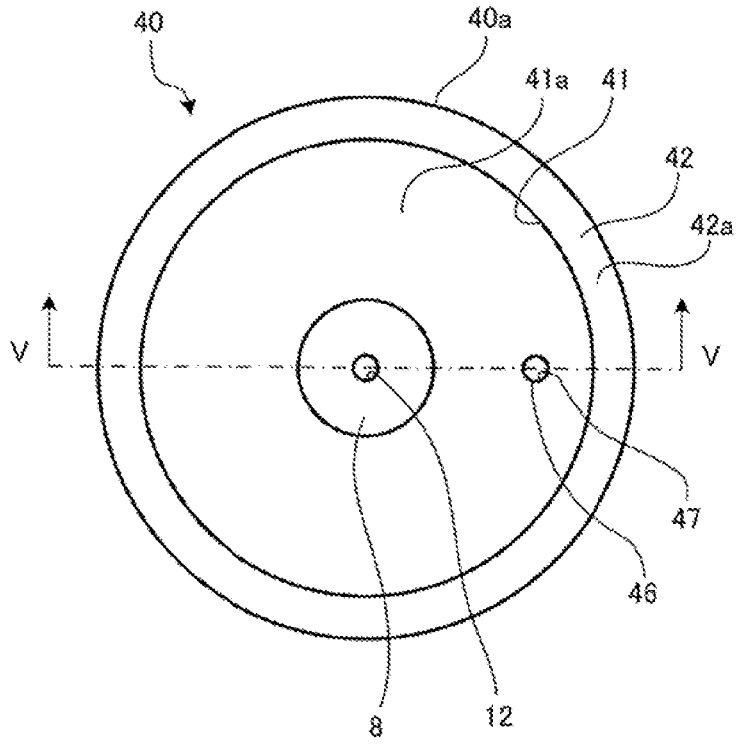
FIG. 2 is a top view illustrating a configuration including a first balance weight 40 and a main shaft 8 of the compressor 100 according to Embodiment 1 of the present invention.
Figure 3:
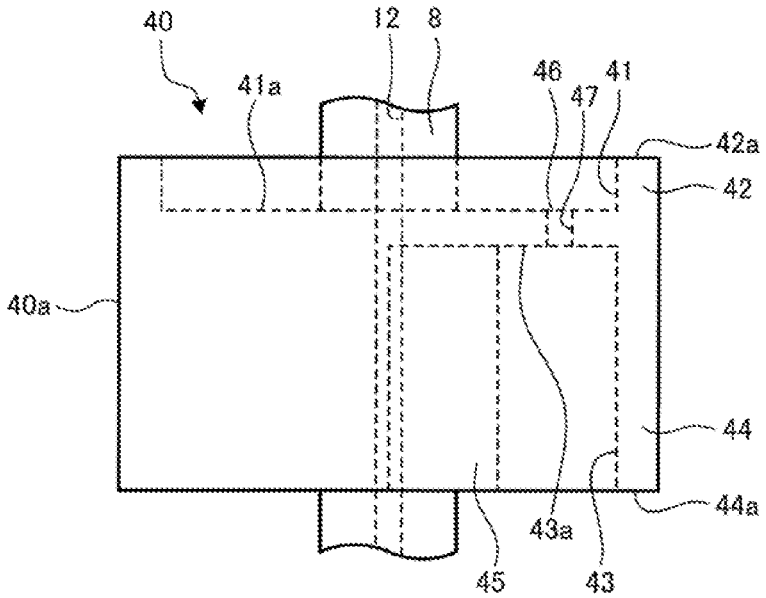
FIG. 3 is a side view illustrating the configuration including the first balance weight 40 and the main shaft 8 of the compressor 100 according to Embodiment 1 of the present invention.
Figure 4:
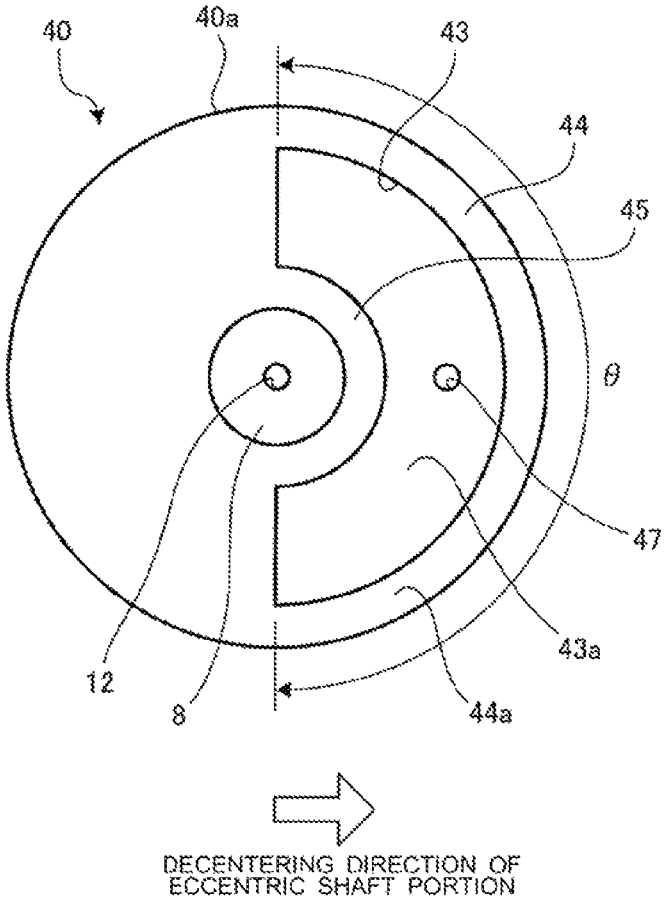
FIG. 4 is a bottom view illustrating the configuration including the first balance weight 40 and the main shaft 8 of the compressor 100 according to Embodiment 1 of the present invention.
Figure 5:
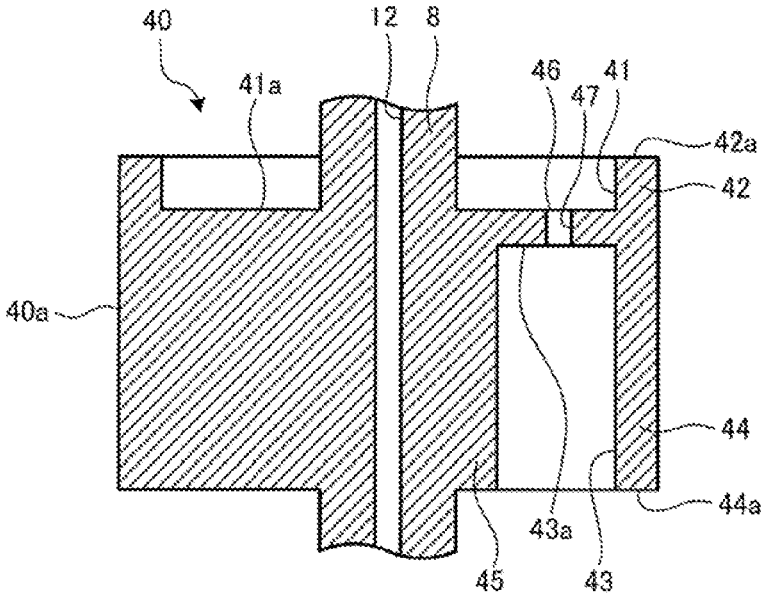
FIG. 5 is a sectional view taken along line V-V illustrated in FIG. 2.

FIG. 2 is a top view illustrating a configuration including the first balance weight 40 and the main shaft 8 of the compressor 100 according to Embodiment 1. FIG. 3 is a side view illustrating the configuration including the first balance weight 40 and the main shaft 8 of the compressor 100 according to Embodiment 1. FIG. 4 is a bottom view illustrating the configuration including the first balance weight 40 and the main shaft 8 of the compressor 100 according to Embodiment 1. FIG. 5 is a sectional view taken along line V-V illustrated in FIG. 2. As illustrated in FIGS. 2 to 5, the first balance weight 40 has a cylindrical outer peripheral surface 40*a* centered at the main shaft 8. The first balance weight 40 according to Embodiment 1 is integrally molded together with the main shaft 8. That is, the main shaft 8 and the first balance weight 40 according to Embodiment 1 are seamlessly and integrally formed of one material.

The first balance weight 40 has an annular oil-receiving recessed portion 41 in an upper surface (i.e., a surface facing the compression mechanism 101) thereof. The oil-receiving recessed portion 41 is centered at the main shaft 8 and is integrated with the first balance weight 40. An outer peripheral side of the oil-receiving recessed portion 41 is defined by an annular outer peripheral wall 42 that includes an upper part of the outer peripheral surface 40*a*. An inner peripheral side of the oil-receiving recessed portion 41 is defined by the outer peripheral surface of the main shaft 8. The oil-receiving recessed portion 41 receives the lubricating oil that runs down the main shaft 8. The space in the oil-receiving recessed portion 41 is roughly separated from the low-pressure chamber 17 by the outer peripheral wall 42. A lower end 20*a* of the main bearing 20 (for example, a lower end of the frame 19) is positioned in the oil-receiving recessed portion 41 (see FIG. 1). That is, the main bearing 20 is positioned on the inner side relative to the outer peripheral wall 42, and the lower end 20*a* of the main bearing 20 is positioned below an upper end surface 42*a* of the outer peripheral wall 42.

The lubricating oil supplied to the sliding parts such as the compression mechanism 101 and the main bearing 20 runs down the main shaft 8 into the low-pressure chamber 17. When the lubricating oil having run down into the low-pressure chamber 17 contacts the low-pressure refrigerant sucked in the low-pressure chamber 17 from the suction pipe 14, the lubricating oil tends to be blown upward and stirred by the refrigerant. In Embodiment 1, the lubricating oil running down the main shaft 8 can be made to flow into the oil-receiving recessed portion 41. Therefore, the contact between the lubricating oil and the refrigerant can be suppressed. Consequently, the stirring of the lubricating oil by the refrigerant can be prevented. In particular, since the lower end 20*a* of the main bearing 20 is positioned in the oil-receiving recessed portion 41, the contact between the lubricating oil running down the main shaft 8 into the oil-receiving recessed portion 41 and the refrigerant in the low-pressure chamber 17 can be suppressed more assuredly.

The deeper the oil-receiving recessed portion 41, the lower the probability of contact between the lubricating oil and the refrigerant. However, the size of the first balance weight 40 in the axial direction is limited. If the oil-receiving recessed portion 41 is too deep, a hollow portion 43, to be described below, becomes shallow. In such a case, it is difficult for the first balance weight 40 to cancel out a satisfactory amount of imbalance. Hence, the oil-receiving recessed portion 41 desirably has a depth that is enough for preventing overflow of the lubricating oil flowing thereinto.

A bottom 41*a* of the oil-receiving recessed portion 41 is provided with an oil outlet 46 from which the lubricating oil having flowed into the oil-receiving recessed portion 41 is discharged. The oil outlet 46 forms an inlet of an oil-discharge path 47 to be described below. The bottom 41*a* of the oil-receiving recessed portion 41 may be level and flat or slant toward the oil outlet 46. If the bottom 41*a* of the oil-receiving recessed portion 41 slants toward the oil outlet 46, the lubricating oil having flowed into the oil-receiving recessed portion 41 can be discharged efficiently from the oil outlet 46.

The first balance weight 40 has the hollow portion 43 in a lower surface (i.e., a surface facing the oil sump portion 31) thereof. The hollow portion 43 extends in part of the lower surface in the peripheral direction around the main shaft 8 and is integrated with the first balance weight 40. The hollow portion 43 is a recess provided in the lower surface of the first balance weight 40. The hollow portion 43 is provided in the decentering direction of the eccentric shaft portion 8*a* relative to the main shaft 8 as represented by a bold arrow in FIG. 4. Hence, the center of gravity of the first balance weight 40 is decentered from the center axis of the main shaft 8 in a direction opposite to the decentering direction of the eccentric shaft portion 8*a*. In Embodiment 1, the hollow portion 43 is present only on the side of the center axis of the main shaft 8 toward which the eccentric shaft portion 8*a* is decentered, and the hollow portion 43 has a sector shape spreading over an angular range θ (for example, θ=180 degrees). An outer peripheral side of the hollow portion 43 is defined by an arc-shaped outer peripheral wall 44 that includes a lower part of the outer peripheral surface 40*a*. An inner peripheral side of the hollow portion 43 is defined by an arc-shaped inner peripheral wall 45 extending along the outer peripheral surface of the main shaft 8.

If the outer peripheral wall 44 is too thick, the amount of imbalance cancellation by the first balance weight 40 becomes too small. On the contrary, if the outer peripheral wall 44 is too thin, the rigidity of the first balance weight 40 may be reduced. Therefore, the outer peripheral wall 44 desirably has a moderate thickness.

The hollow portion 43 is deeper than the oil-receiving recessed portion 41. Thus, the first balance weight 40 can cancel out an increased amount of imbalance.

The angular range θ over which the hollow portion 43 spreads is not limited to 180 degrees. The angular range θ may be smaller than 180 degrees (0 degrees<θ<180 degrees). In that case, the reduction in the rigidity of the first balance weight 40 that occurs with the presence of the hollow portion 43 can be suppressed. The angular range θ may be greater than 180 degrees (180 degrees<θ<360 degrees).

The oil-discharge path 47 extends between the bottom 41*a* of the oil-receiving recessed portion 41 and a bottom 43*a* of the hollow portion 43. The oil-discharge path 47 is a through hole extending parallel to the main shaft 8. The oil-receiving recessed portion 41 and the hollow portion 43 communicate with each other through the oil-discharge path 47 and on the inside of the first balance weight 40 (i.e., on the inner side of the outer peripheral surface 40*a*). The oil-discharge path 47 has a circular shape in sectional view. As viewed from a direction parallel to the main shaft 8, the oil-discharge path 47 has a smaller area than both the oil-receiving recessed portion 41 and the hollow portion 43. In Embodiment 1, one oil-discharge path 47 is provided. Alternatively, a plurality of oil-discharge paths may be provided.

The lubricating oil having flowed into the oil-receiving recessed portion 41 flows through the oil outlet 46, the oil-discharge path 47, and the hollow portion 43 and is discharged toward the electric motor 102 provided below the oil-receiving recessed portion 41. The oil outlet 46, the oil-discharge path 47, and the hollow portion 43 are all provided inside the first balance weight 40. Therefore, the lubricating oil can be returned to the oil sump portion 31 while the contact between the lubricating oil and the refrigerant is suppressed. Accordingly, the stirring of the lubricating oil by the refrigerant can be prevented.

In Embodiment 1, a lower end surface 44*a* of the outer peripheral wall 44 (i.e., the lower end of the first balance weight 40) is positioned below an upper end 10*a*1 of an insulator 10*a* (i.e., the upper end of the stator 10) (see FIG. 1). The lower end surface 44*a* of the outer peripheral wall 44 is positioned on the inner side with respect to the upper end 10*a*1 of the insulator 10*a*. Therefore, the flow of the refrigerant sucked in from the suction pipe 14 is stopped at a gap between the first balance weight 40 and the insulator 10*a*. Accordingly, the lubricating oil discharged downward from the lower side of the first balance weight 40 through the hollow portion 43 can be prevented from being stirred by the refrigerant.

As described above, the compressor 100 according to Embodiment 1 includes the compression mechanism 101 that compresses the refrigerant, the main shaft 8 that transmits a rotational driving force to the compression mechanism 101, the first balance weight 40 (an exemplary balance weight) provided on the main shaft 8 and below the compression mechanism 101 and having the cylindrical outer peripheral surface 40*a* centered at the main shaft 8, and the oil sump portion 31 provided below the first balance weight 40 and stores the lubricating oil to be supplied to the compression mechanism 101. The first balance weight 40 has the annular oil-receiving recessed portion 41 in the upper surface thereof. The oil-receiving recessed portion 41 is centered at the main shaft 8. The first balance weight 40 has the hollow portion 43 in the lower surface thereof. The hollow portion 43 extends in part of the lower surface in the peripheral direction around the main shaft 8. The oil-receiving recessed portion 41 communicates with at least part of the hollow portion 43.

With such a configuration, the lubricating oil supplied to the compression mechanism 101 and running down the main shaft 8 flows into the oil-receiving recessed portion 41, flows through the inside of the first balance weight 40 and through the hollow portion 43, and is discharged to the oil sump portion 31. Hence, the contact between the lubricating oil and the refrigerant can be suppressed. Consequently, the stirring of the lubricating oil by the refrigerant can be prevented. Such a configuration prevents oil loss caused by rising of stirred lubricating oil upward and discharged to the outside of the compressor 100 together with the refrigerant. Furthermore, the oil-receiving recessed portion 41 and the hollow portion 43 are both provided in the first balance weight 40, which is a single component. Hence, a separate component such as a balancer cover does not need to be provided. Accordingly, the increase in the number of components forming the compressor 100 and in the number of steps of assembling the compressor 100 can be suppressed.

In the compressor 100 according to Embodiment 1, the first balance weight 40 is integrally molded together with the main shaft 8.

With such a configuration, the number of components forming the compressor 100 can be reduced. Furthermore, no step of fixing the first balance weight 40 to the main shaft 8 by shrink fitting or any other method is necessary. Therefore, the process of assembling the compressor 100 can be simplified.

The compressor 100 according to Embodiment 1 further includes the main bearing 20 (an exemplary bearing) provided below the compression mechanism 101 and supporting the main shaft 8 such that the main shaft 8 can be rotated. The lower end 20*a* of the main bearing 20 is positioned in the oil-receiving recessed portion 41.

In such a configuration, the lubricating oil running down the main shaft 8 from the compression mechanism 101 or from the main bearing 20 can be made to flow into the oil-receiving recessed portion 41, avoiding the contact with the refrigerant. Therefore, the stirring of the lubricating oil by the refrigerant can be prevented more assuredly.

The compressor 100 according to Embodiment 1 further includes the electric motor 102 provided below the first balance weight 40 and above the oil sump portion 31 and that drives the compression mechanism 101 through the main shaft 8. The lower end of the first balance weight 40 (for example, the lower end surface 44*a* of the outer peripheral wall 44) is positioned below the upper end of the stator 10 of the electric motor 102 (for example, the upper end 10*a*1 of the insulator 10*a*).

With such a configuration, the lubricating oil discharged downward from the lower side of the first balance weight 40 through the hollow portion 43 can be prevented from being stirred by the refrigerant sucked in from the suction pipe 14.

In the compressor 100 according to Embodiment 1, the hollow portion 43 is deeper than the oil-receiving recessed portion 41.

With such a configuration, the first balance weight 40 can cancel out an increased amount of imbalance.

With the configuration according to Embodiment 1, if the size of the first balance weight 40 is limited, the amount of imbalance cancellation may be difficult to increase. Hence, in the compressor 100 according to Embodiment 1, the orbiting scroll 2 is desirably made of aluminum. An aluminum orbiting scroll is lighter than an iron-cast orbiting scroll. Therefore, the amount of imbalance that is required to be cancelled out is relatively small.

Embodiment 2

Figure 6:
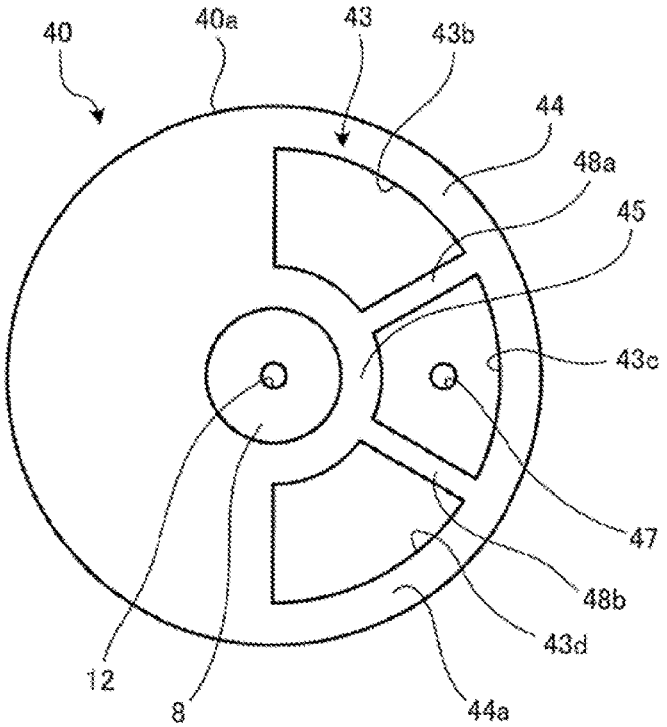
FIG. 6 is a bottom view illustrating a configuration including a first balance weight 40 and a main shaft 8 of a compressor 100 according to Embodiment 2 of the present invention.

A compressor according to Embodiment 2 of the present invention will now be described. FIG. 6 is a bottom view illustrating a configuration including a first balance weight 40 and a main shaft 8 of a compressor 100 according to Embodiment 2. Embodiment 2 differs from Embodiment 1 in the configuration of the hollow portion 43. Elements having the same functions and behaving in the same manners as those described in Embodiment 1 are denoted by corresponding ones of the reference numerals, and description of such elements is omitted.

As illustrated in FIG. 6, the first balance weight 40 according to Embodiment 2 has two ribs 48*a* and 48*b* each extending in the radial direction from the main shaft 8 and across the hollow portion 43. The ribs 48*a* and 48*b* are integrally molded together with the body of the first balance weight 40. That is, the body of the first balance weight 40 and the ribs 48*a* and 48*b* are seamlessly and integrally formed of one material. The ribs 48*a* and 48*b* each have the same height as or a smaller height than the outer peripheral wall 44. The hollow portion 43 is sectioned by the ribs 48*a* and 48*b* into three hollow portions 43*b*, 43*c*, and 43*d*. The hollow portions 43*b*, 43*c*, and 43*d* all have substantially the same sector shape. One of the three hollow portions 43*b*, 43*c*, and 43*d*, namely the hollow portion 43*c*, communicates with the oil-receiving recessed portion 41 through the oil-discharge path 47.

In Embodiment 2, two ribs 48*a* and 48*b* are provided. Alternatively, one rib or three or more ribs may be provided. In Embodiment 2, the ribs 48*a* and 48*b* extend in the radial direction. Alternatively, the ribs may extend in the peripheral direction or another direction. In Embodiment 2, only the hollow portion 43*c* communicates with the oil-receiving recessed portion 41. Alternatively, the other hollow portions 43*b* and 43*d*, as well as the hollow portion 43*c*, may communicate with the oil-receiving recessed portion 41. For example, a plurality of oil-discharge paths that allow the respective hollow portions 43*b*, 43*c*, and 43*d* to communicate with the oil-receiving recessed portion 41 may be provided.

As described above, in the compressor 100 according to Embodiment 2, the first balance weight 40 has at least one rib 48*a* or 48*b* extending across the hollow portion 43.

In such a configuration, the hollow portion 43 of the first balance weight 40 can be reinforced by the at least one rib 48*a* or 48*b*. Therefore, the deformation of the first balance weight 40 under a stress generated while the compressor 100 is in operation can be suppressed. Consequently, the reliability of the compressor 100 can be increased.

Embodiment 3

Figure 7:
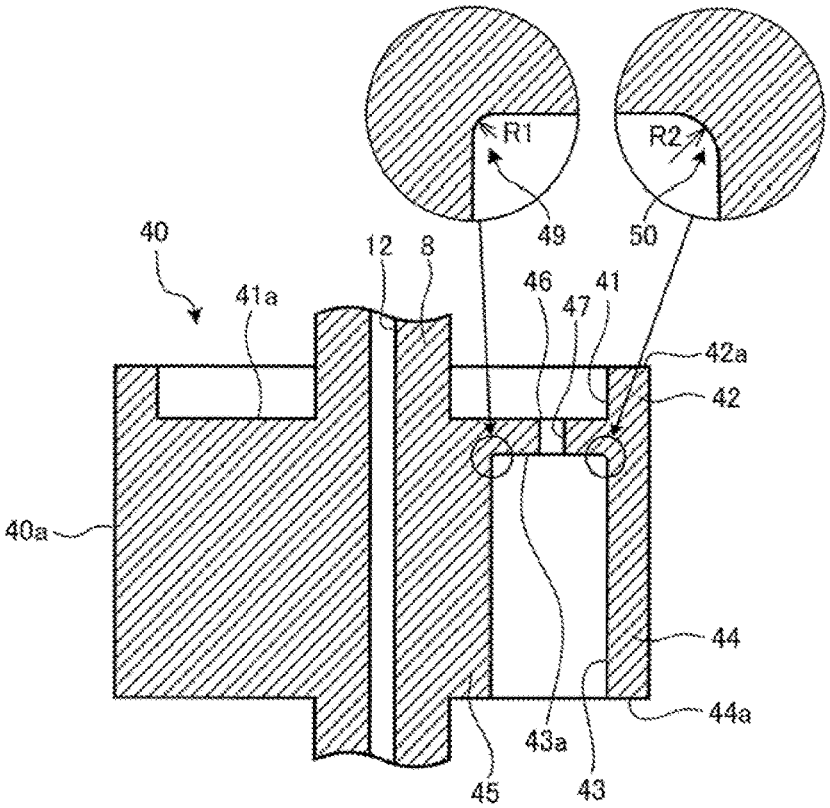
FIG. 7 is a sectional view illustrating a configuration including a first balance weight 40 and a main shaft 8 of a compressor 100 according to Embodiment 3 of the present invention.

A compressor according to Embodiment 3 of the present invention will now be described. FIG. 7 is a sectional view illustrating a configuration including a first balance weight 40 and a main shaft 8 of a compressor 100 according to Embodiment 3. The section illustrated in FIG. 7 corresponds to the section illustrated in FIG. 5. Embodiment 3 differs from Embodiment 1 in the shapes of corners of the hollow portion 43. Elements having the same functions and behaving in the same manners as those described in Embodiment 1 are denoted by corresponding ones of the reference numerals, and description of such elements is omitted.

In the section illustrated in FIG. 7 that is taken along a plane including the center axis of the main shaft 8 and passing through the first balance weight 40 and the main shaft 8, the hollow portion 43 has a corner 49 (an exemplary first corner) between the bottom 43*a* and the inner peripheral wall 45. In the same section, the hollow portion 43 further has a corner 50 (an exemplary second corner) between the bottom 43*a* and the outer peripheral wall 44. At least one of the corners 49 and 50, namely the corner 50, forms a round corner. Letting the curvature radius of the corner 49 be R1 and the curvature radius of the corner 50 be R2, the curvature radius R2 is greater than the curvature radius R1 ($R2>R1\geq 0$).

While the compressor 100 is in operation, the outer peripheral wall 44 is more likely to deform under the stress than the inner peripheral wall 45. Increasing the curvature radius R2 of the corner 50 at the outer peripheral wall 44 increases the rigidity of the outer peripheral wall 44. Consequently, the deformation of the outer peripheral wall 44 can be suppressed. On the other hand, reducing the curvature radius R1 of the corner 49 at the inner peripheral wall 45 increases the amount of imbalance cancellation by the first balance weight 40.

As described above, in the compressor 100 according to Embodiment 3, the corner 49 (an exemplary first corner) is formed between the bottom 43*a* of the hollow portion 43 and the inner peripheral wall 45 of the hollow portion 43, and the corner 50 (an exemplary second corner) is formed between the bottom 43*a* of the hollow portion 43 and the outer peripheral wall 44 of the hollow portion 43. The corner 50 has the curvature radius R2 that is greater than the curvature radius R1 of the corner 49.

In such a configuration, the deformation of the outer peripheral wall 44 that may occur while the compressor 100 is in operation can be suppressed, and the first balance weight 40 can cancel out a large amount of imbalance.

The present invention is not limited to Embodiments 1 to 3 described above and various modifications are possible.

For example, while Embodiments 1 to 3 each concern a case where the main shaft 8 and the first balance weight 40 are integrally molded, the main shaft 8 and the first balance weight 40 may be separate from each other. The first balance weight 40 by itself has at least a function of cancelling out the imbalance and a function of preventing the stirring of the lubricating oil. Therefore, even if the main shaft 8 and the first balance weight 40 are separate from each other, the advantageous effect of suppressing the increase in the number of components forming the compressor 100 can be produced.

In Embodiments 1 to 3, although an explanation is made taking as an example a case where the oil-receiving recessed portion 41 and the hollow portion 43 communicate with each other through the oil-discharge path 47, the hollow portion 43 may be deep enough to reach the oil-receiving recessed portion 41. In that case, the oil-receiving recessed portion 41 and the hollow portion 43 directly communicate with each other, with no need of providing the oil-discharge path 47.

In Embodiments 1 to 3, an explanation is made by taking as an example a scroll compressor. However, no limitation there to is intended, and application to other types of compressor is possible.

Features of Embodiments 1 to 3 may be combined in any way.

REFERENCE SIGNS LIST

1 fixed scroll 1*a* fixed-scroll lap 1*b* fixed-scroll base plate 2 orbiting scroll 2*a* orbiting-scroll lap 2*b* orbiting-scroll base plate 2*c* thrust-bearing surface 2*d* boss portion 3 thrust plate 4, 5 Oldham-key groove 6 Oldham ring 6*a* ring portion 6*b*, 6*c* Oldham key 7 casing 8 main shaft 8*a* eccentric shaft portion 9 power-supply terminal 10 stator 10*a* insulator 10*a*1 upper end 11 rotor 12 oil-supply hole 12*a* axial-direction hole 12*b* lateral hole 13 second balance weight 14 suction pipe 15 discharge port discharge pipe 17 low-pressure chamber 18 high-pressure chamber 19 frame 20 main bearing 20*a* lower end 21 upper shell 22 lower shell 23 center shell 24 compression chamber 25, 26 seal 27 discharge valve 28 subframe 29 secondary bearing 30 oil pump 31 oil sump portion 40 first balance weight 40*a* outer peripheral surface 41 oil-receiving recessed portion 41*a* bottom 42 outer peripheral wall 42*a* upper end surface 43, 43*b*, 43*c*, 43*d* hollow portion 43*a* bottom 44 outer peripheral wall 44*a* lower end surface 45 inner peripheral wall 46 oil outlet 47 oil-discharge path 48*a*, 48*b* rib 49, 50 corner 100 compressor 101 compression mechanism 102 electric motor R1, R2 curvature radius θ angular range

The invention claimed is:

1. A compressor comprising:

a compression mechanism configured to compress refrigerant;

a main shaft that transmits a rotational driving force to the compression mechanism;

a balance weight provided below the compression mechanism and provided on the main shaft, the balance weight having a cylindrical outer peripheral surface centered at the main shaft; and an oil sump portion provided below the balance weight and that stores lubricating oil to be supplied to the compression mechanism, wherein the balance weight has an annular oil-receiving recessed portion in an upper surface, the oil-receiving recessed portion being centered at the main shaft and integrated with the balance weight, wherein the balance weight has a hollow portion in a lower surface, the hollow portion extending in part of the lower surface in a peripheral direction around the main shaft and being integrated with the balance weight, wherein the oil-receiving recessed portion communicates with at least part of the hollow portion, and wherein a first corner is formed between a bottom of the hollow portion and an inner peripheral wall of the hollow portion and a second corner is formed between the bottom of the hollow portion and an outer peripheral wall of the hollow portion, wherein the second corner has a curvature radius that is greater than a curvature radius of the first corner.

2. The compressor of claim 1, wherein the balance weight is integrally molded with the main shaft.

3. The compressor of claim 1, wherein the balance weight has a rib extending across the hollow portion.

4. The compressor of claim 1, further comprising:

a bearing provided below the compression mechanism and supporting the main shaft such that the main shaft can be rotated, wherein a lower end of the bearing is positioned in the oil-receiving recessed portion.

5. The compressor of claim 1, further comprising:

an electric motor provided below the balance weight and above the oil sump portion and that drives the compression mechanism through the main shaft, wherein a lower end of the balance weight is positioned below an upper end of a stator of the electric motor.

6. The compressor of claim 1, wherein a length of the hollow portion in a direction between an upper end surface of the outer peripheral wall and a lower end surface of the outer peripheral wall is greater than a length of the oil-receiving recessed portion in the direction between the upper end surface of the outer peripheral wall and the lower end surface of the outer peripheral wall.

7. The compressor of claim 1, wherein the balance weight serves as a first balance weight, and the compressor further comprises a second balance weight provided below the first balance weight.

8. The compressor of claim 7, further comprising:

a rotor located between the first balance weight and the second balance weight.

9. The compressor of claim 8, wherein the second balance weight is integrally fixed to the rotor.

10. The compressor of claim 1, wherein the hollow portion is formed only in a first half of the balance weight, the other half of the balance weight being solid.

* * * * *